US007978212B2

(12) United States Patent
Zama et al.

(10) Patent No.: US 7,978,212 B2
(45) Date of Patent: Jul. 12, 2011

(54) DISK LABEL PRINTER

(75) Inventors: Hiroyoshi Zama, Fukushima-ken (JP); Takashi Goto, Fukushima-ken (JP); Mitsuo Makino, Fukushima-ken (JP); Shinichi Sagawai, Fukushima-ken (JP); Mitsuaki Yamazaki, Fukushima-ken (JP); Eihin Setsu, Fukushima-ken (JP); Hisashi Hoshino, Fukushima-ken (JP); Tomohiro Osumi, Fukushima-ken (JP); Shinichiro Kimura, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 590 days.

(21) Appl. No.: 12/141,587

(22) Filed: Jun. 18, 2008

(65) Prior Publication Data

US 2009/0015648 A1 Jan. 15, 2009

(30) Foreign Application Priority Data

Jul. 9, 2007 (JP) ..... 2007-179836

(51) Int. Cl.
*B41J 2/32* (2006.01)

(52) U.S. Cl. ..... 347/171; 347/197

(58) Field of Classification Search ..... 347/171, 347/197; 400/120.01, 120.16
See application file for complete search history.

(56) References Cited

U.S. PATENT DOCUMENTS 5,317,337 A * 5/1994 Ewaldt ..... 347/2
5,518,325 A * 5/1996 Kahle ..... 400/70
5,542,768 A * 8/1996 Rother et al. ..... 400/120.16
5,967,676 A * 10/1999 Cutler et al. ..... 400/70
6,148,722 A * 11/2000 Hagstrom ..... 101/35
6,302,601 B1 * 10/2001 Hagstrom et al. ..... 400/283
6,312,174 B1 * 11/2001 Drynkin et al. ..... 400/120.16
6,447,181 B1 * 9/2002 Hagstrom et al. ..... 400/120.01
7,009,632 B2 3/2006 Sawyer

FOREIGN PATENT DOCUMENTS

JP 9-265760 * 10/1997
JP 11-339441 12/1999
JP 2005-119240 5/2005

* cited by examiner

*Primary Examiner* — Huan H Tran
(74) *Attorney, Agent, or Firm* — Brinks Hofer Gilson & Lione

(57) ABSTRACT

Disclosed is a disk label printer that includes a slot-in type optical disk driving mechanism and a printing mechanism integrated with each other, has a small size, and smoothly transfers optical disks. The disclosed disk label printer includes: a case that has a slot through which an optical disk is inserted or ejected formed therein; an optical disk driving mechanism that is provided in the case and writes and/or reads signals to and/or from the optical disk mounted to a disk mounting portion; and a printing mechanism that is provided in the case and includes a thermal head which prints a desired image on a label surface of the optical disk. The printing mechanism is provided on a transfer path of the optical disk toward the optical disk driving mechanism between the slot and the optical disk driving mechanism. The thermal head and a platen roller come into pressure contact with each other with the optical disk interposed therebetween on the transfer path, only when the optical disk is transferred during the driving of the printing mechanism. The thermal head and the platen roller are withdrawn from the transfer path so as to be separated from each other, when the optical disk is transferred during operations other than the driving of the printing mechanism.

3 Claims, 7 Drawing Sheets

DISK LABEL PRINTER

This application claims priority to the Japanese Patent Application No. 2007-179826, filed Jul. 9, 2007, the entirety of which is hereby incorporated by reference in its entirety.

BACKGROUND

1. Technical Field

The present invention relates to a disk label printer that is integrated with an optical disk drive (ODD) and prints a desired image on a label surface of an optical disk inserted into the ODD.

2. Related Art

In recent years, disk drives (optical disk drives. Hereinafter, referred to as ODDs) corresponding to optical disk recording media (hereinafter, referred to as disks), such as CD-R (compact disk recordable), DVD-R (digital versatile disk recordable), CD-RW (compact disk rewritable), and DVD-RW (digital versatile disk rewritable), have been used to simply create original music albums, photo albums, and DVD albums.

Therefore, there are increasing demands for originally designing the label of the created disk.

In order to meet the demands, recently, intermediate transfer type printers have come into widespread use since they have advantages of, for example, high-quality printing, low noise, low cost, and easy maintenance. The intermediate transfer type print prints a desired image by primarily transferring ink of an ink film onto an intermediate transfer sheet using a line thermal head to form a primary transfer image and by retransferring the primary transfer image onto a label surface of a disk using a retransfer unit (see JP-A-2005-119240).

Furthermore, there has been proposed a rotary disk label printer that is provided in one standard bay of a personal computer system (see JP-A-11-339441).

The disk label printer performs printing by rotating a disk stored in a disk storage tray, similar to a known disk drive, and moving an ink jet head having an ink cartridge provided therein in the radius direction from the outer circumference of the disk to the center thereof.

Further, there has been proposed an ink jet printer that is integrated with a disk drive (see Japanese Patent No. 3341572).

However, the intermediate transfer type printer disclosed in JP-A-2005-119240 is provided separately from the disk drive and is large in size. Therefore, the intermediate transfer type printer does not meet needs of users to print desired labels on the surfaces of the disks.

The disk label printer disclosed in JP-A-11-339441 has a small size and meets needs for the users to print desired labels on the surfaces of the disks. However, the disk label printer is provided separately from the disk drive, similar to the intermediate transfer type printer disclosed in JP-A-2005-119240.

The following have been used as the disk drive: a type of disk drive in which a user opens a cover or a door provided in a case and manually loads an optical disk on a disk mounting portion; another type of disk drive in which an optical disk is loaded on a disk tray that is ejected from the case in the horizontal direction, and when the disk tray is closed, the optical disk is automatically mounted to a disk mounting portion in the case (tray type); and a slot-in type in which, when an optical disk is inserted into a slot formed in the front surface of a case, the optical disk is automatically loaded on a disk mounting portion. In recent years, there have been increasing demands for the slot-in type disk drive with high operability.

However, in the slot-in type disk drive, a disk transfer unit that transfers an optical disk into the case through the slot is also provided on a label surface side of the disk mounting portion. Therefore, it is difficult to arrange the ink jet head so as to be movable on the label surface in the radius direction, and it is difficult to apply the disk label printer disclosed in JP-A-11-339441 to the slot-in type disk drive.

The ink jet printer disclosed in Japanese Patent No. 3341572 is integrated with the disk drive, but the structure for providing the ink jet head so as to be movable on the label surface becomes complicated, which makes it difficult to reduce the size of an apparatus.

SUMMARY

A disk label printer includes: a case that has a slot through which an optical disk is inserted or ejected formed therein; an optical disk driving mechanism that is provided in the case and writes and/or reads signals to and/or from the optical disk mounted to a disk mounting portion; and a printing mechanism that is provided in the case and includes a thermal head which prints a desired image on a label surface of the optical disk interposed between the thermal head and a platen roller. The printing mechanism is provided on a transfer path of the optical disk toward the optical disk driving mechanism between the slot and the optical disk driving mechanism. The thermal head and the platen roller come into pressure contact with each other with the optical disk interposed therebetween on the transfer path, only when the optical disk is transferred during the driving of the printing mechanism. The thermal head and the platen roller are withdrawn from the transfer path so as to be separated from each other, when the optical disk is transferred during operations other than the driving of the printing mechanism.

The disk label printer having the above-mentioned structure performs a loading operation of transferring the optical disk into the case through the slot, and an ejecting operation of ejecting the optical disk from the case through the slot.

In the disk label printer according to the above-mentioned structure, the thermal head and the platen roller of the printing mechanism, which is provided on the transfer path of the optical disk toward the optical disk driving mechanism between the slot and the optical disk driving mechanism, come into pressure contact with each other with the optical disk interposed therebetween on the transfer path, only when the optical disk is transferred during the driving of the printing mechanism. In addition, the thermal head and the platen roller are withdrawn from the transfer path so as to be separated from each other, when the optical disk is transferred during operations other than the driving of the printing mechanism. According to this structure, it is possible to prevent the printing mechanism from hindering the transfer of the optical disk toward the optical disk driving mechanism.

DESCRIPTION OF EXEMPLARY EMBODIMENTS

An ODD-integrated disk label printer according to an embodiment of the disclosure is a so-called thin slot-in type that is provided in an electronic apparatus, such as a portable personal computer. The ODD-integrated disk label printer may be an external disk label printer that can be connected to an electronic apparatus by, for example, a USB.

Figure 1:
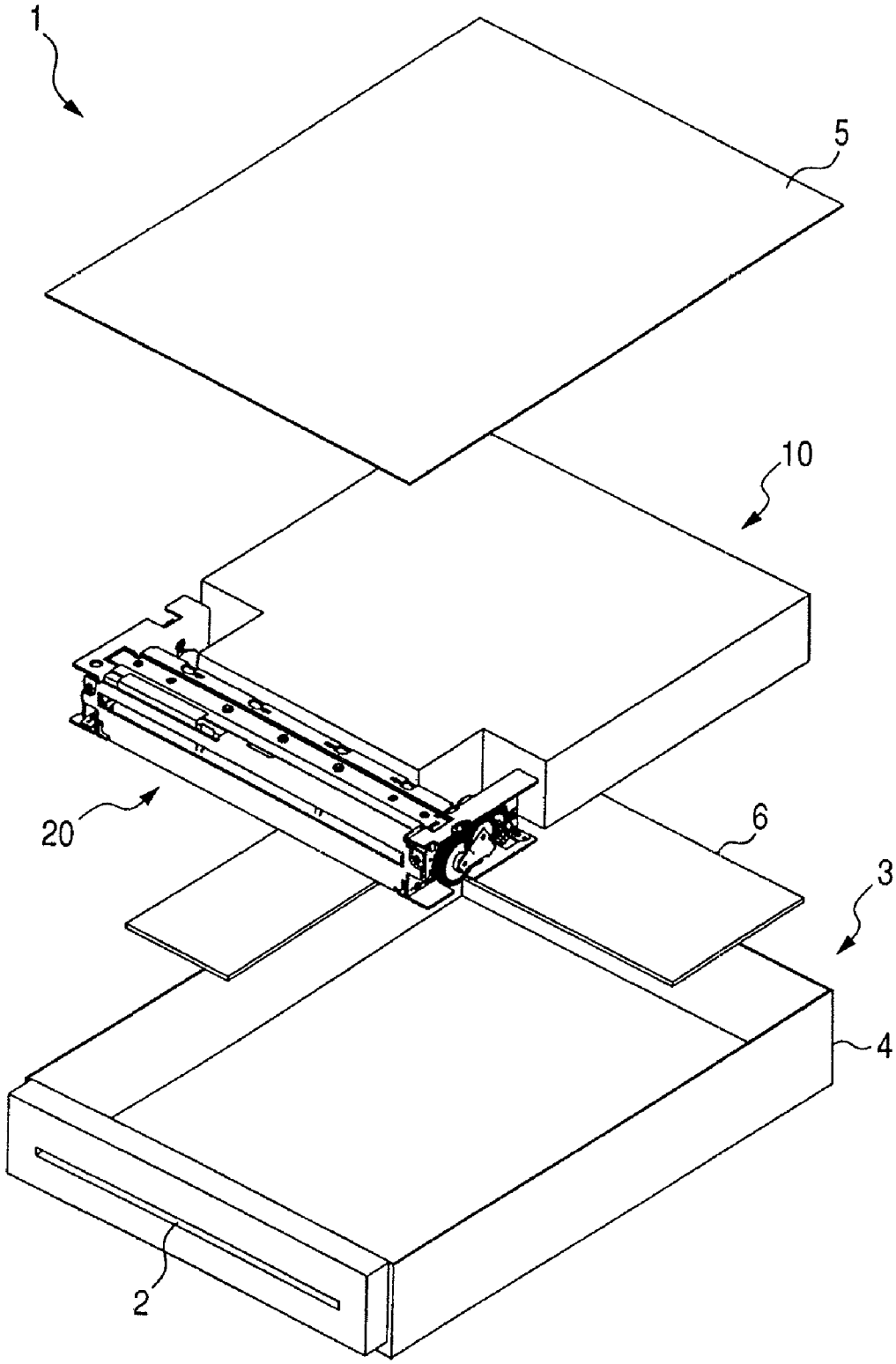
FIG. 1 is an exploded perspective view illustrating the arrangement of an optical disk driving mechanism and a printing mechanism provided in a case of a disk label printer according to an embodiment of the disclosure.

As shown in FIG. 1, a disk label printer 1 according to this embodiment includes a thin case 3 having a slot 2 through which an optical disk D is inserted or ejected formed in the front surface thereof.

The case 3 includes a drawer-shaped case body 4 having the slot 2 formed its front surface and a top board 5 that covers the entire upper surface of the case body 4. The front surface is provided with a display unit (not shown) having lamps that are turned on or off to indicate the access state of the optical disk D and an eject button (not shown) that is pushed to eject the optical disk D.

In the case 3, an optical disk driving mechanism 10 having a know structure, such as a so-called slot-in type, is provided on the inside of the front surface, and a printing mechanism 20 according to this embodiment is provided on a transfer path of the optical disk D on the front side of the optical disk driving mechanism, that is, between the slot 2 and the optical disk driving mechanism 10. In addition, a control board 6 that is common to the optical disk driving mechanism 10 and the printing mechanism 20 is provided on the bottom of the case 3 such that it can communicate with the electronic apparatus.

The optical disk driving mechanism 10 includes: a disk mounting portion to which the optical disk D inserted through the slot 2 is mounted; a sensor that can detect whether the optical disk D is mounted to the disk mounting portion and the size of the mounted optical disk D; an optical disk rotating mechanism that rotates the optical disk D mounted to the disk mounting portion; a pickup mechanism that writes and/or reads signals to and/or from the optical disk D rotated by the optical disk rotating mechanism; and a pickup transfer mechanism that transfers the pickup mechanism along the inner circumference of the optical disk D. The optical disk driving mechanism 10 further includes an optical disk transfer mechanism that performs a loading operation of drawing the optical disk D into the case 3 through the slot 2 and transferring the optical disk D to the disk mounting portion and an ejecting operation of ejecting the optical disk D to the outside of the case 3 through the slot 2. The optical disk driving mechanism 10 can correspond to one type of optical disk D (hereinafter, sometime, referred to as a large-diameter disk) having a diameter of 12 cm, which is a standard size, and another type of optical disk D (hereinafter, sometime, referred to as a small-diameter disk) having a diameter of 8 cm that is smaller than that of the large-diameter disk. Since the structure of the optical disk driving mechanism 10 is similar to that disclosed in JP-A-2005-190645, a detailed description of the optical disk driving mechanism 10 will be omitted.

The printing mechanism 20 is for printing a desired image on a label surface DL of the optical disk D. The printing mechanism 20 includes a thermal head 21 that is provided such that it can come into contact with or be separated from the label surface DL and a platen roller 22 that is opposite to the thermal head 21 with the transfer path of the optical disk D interposed therebetween. The thermal head 21 includes an array of heating elements having a length that is equal to or larger than the maximum printing diameter of a disk having a maximum diameter capable of being mounted to the disk mounting portion.

Figure 2:
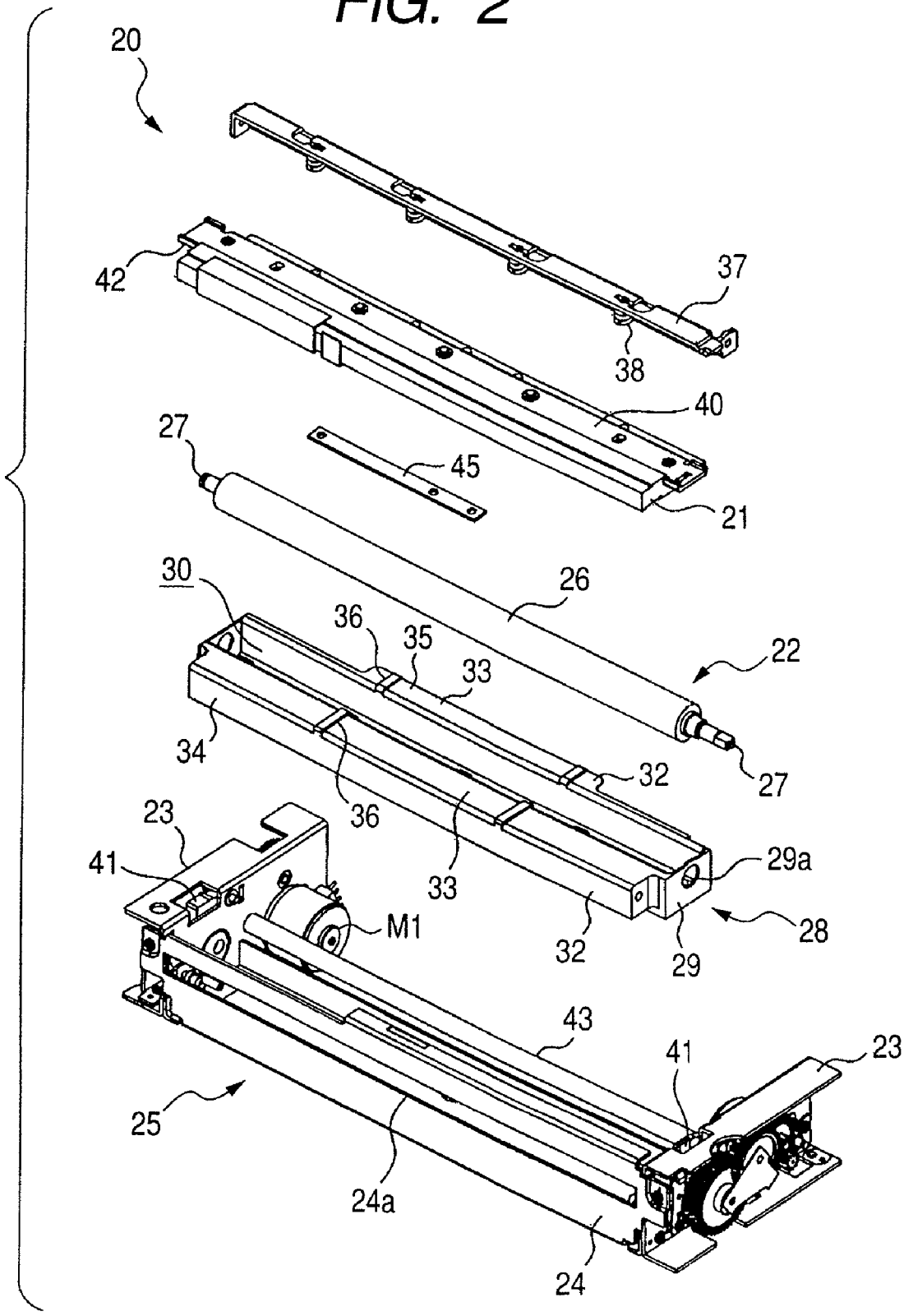
FIG. 2 is an exploded perspective view illustrating main parts of the printing mechanism shown in FIG. 1 (as viewed from the right side)
Figure 3:
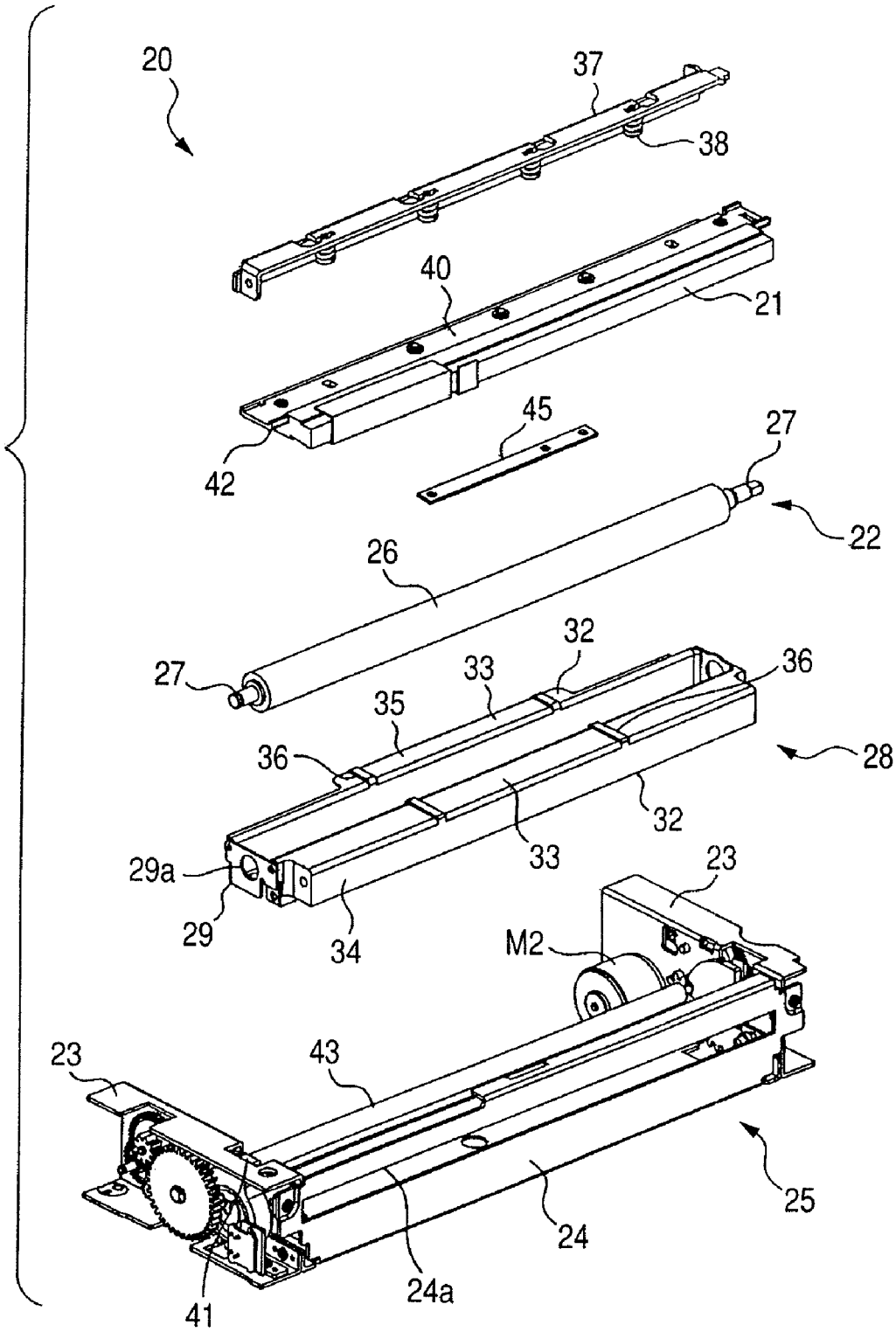
FIG. 3 is an exploded perspective view illustrating the main parts of the printing mechanism shown in FIG. 1 (as viewed from the left side)

Specifically, as shown in FIGS. 2 and 3, the printing mechanism 20 includes a frame 25 having a U shape in plan view. The frame 25 includes a pair of side plates 23 that are opposite to each other with a predetermined gap therebetween and a connecting plate 24 for connecting the ends of the pair of side plates 23. The frame 25 is arranged such that the connecting plate 24 is opposite to the inside of the front surface of the case body 4 having the slot 2 formed therein when the printing mechanism 20 is provided inside the case 3. An opening 24*a* is formed in the connecting plate 24 so as to ensure the transfer path of the optical disk D that is inserted into or ejected from the case 3 through the slot 2.

Further, the platen roller 22 includes an elongated cylindrical roller portion 26 and a shaft 27 that extends from both ends of the roller portion in the longitudinal direction thereof. The platen roller 22 is supported in the vicinity of the connecting plate 24 between the pair of side plates 23, with the roller portion 26 accommodated in a transfer guide member 28.

Specifically, the transfer guide member 28 includes a box-shaped body 29 having a space 30 for rotatably accommodating the roller portion 26 of the platen roller 22. The box-shaped body 29 has an opening at its upper part, and has a U shape in a cross-sectional view. Bores 29*a* into which the shaft 27 of the platen roller 22 is fitted are formed in both end surfaces of the box-shaped body 29 in the longitudinal direction thereof.

Furthermore, a large-diameter bore (not shown) into which a large-diameter shaft-shaped protrusion 51 formed on a cam member 50, which will be described below, is fitted and which rotatably supports the cam member 50 is formed in each of the pair of side plates 23. A pair of cam members 50 are provided. In each of the cam members 50, a bore 50*a* into which the end of the shaft 27 of the platen roller 22 is inserted and fixed is formed in the shaft-shaped protrusion 51 so as to be eccentric from the rotation center of the cam member 50. The structure of the cam member 50 will be described below.

With the roller portion 26 of the platen roller 22 positioned in the space 30, the shaft 27 is sequentially fitted into the bores 29*a* formed in the box-shaped body 29, the bores 23*a* formed in the side plates 23 of the frame 25, and the bores 50*a* formed in the cam members 50 that are rotatably formed on the side plates 23. In this way, the platen roller 22 is movably supported between the pair of side plates 23 so as to be rotated with the rotation of the cam members 50, and the transfer guide member 28 holds the shaft 27 of the platen roller 22 such that the platen roller 22 can be tilted.

Further, transfer guide portions 32 are provided in the transfer guide member 28. The transfer guide portions 32 extend along both side portions forming the opening of the box-shaped body 29 and have guide surfaces 33 for guiding the transfer of the optical disk D. That is, in this embodiment, the transfer guide portions 32 of the transfer guide member 28 include: an outward extending portion 34 that is formed along substantially the entire side of the box-shaped body 29 facing the connecting plate and has the guide surface 33 extending so as to fill up the gap between the transfer guide member and the connecting plate 24; and an inward extending portion 35 that is partially formed at the center of the side of the box-shaped body 29 opposite to the connecting plate and has the guide surface 33 extending in the direction in which the optical disk driving mechanism 10 is arranged. In addition, linear convex portions 36 are formed on the guide surface 33 of each of the outward extending portion 34 and the inward extending portion 35 at target positions from the center of the box-shaped body 29 in the longitudinal direction so as to extend in the width direction of the guide surface. The convex portions 36 come into contact with the optical disk D transferred along the transfer path to guide the transfer of the optical disk D.

Figure 4:
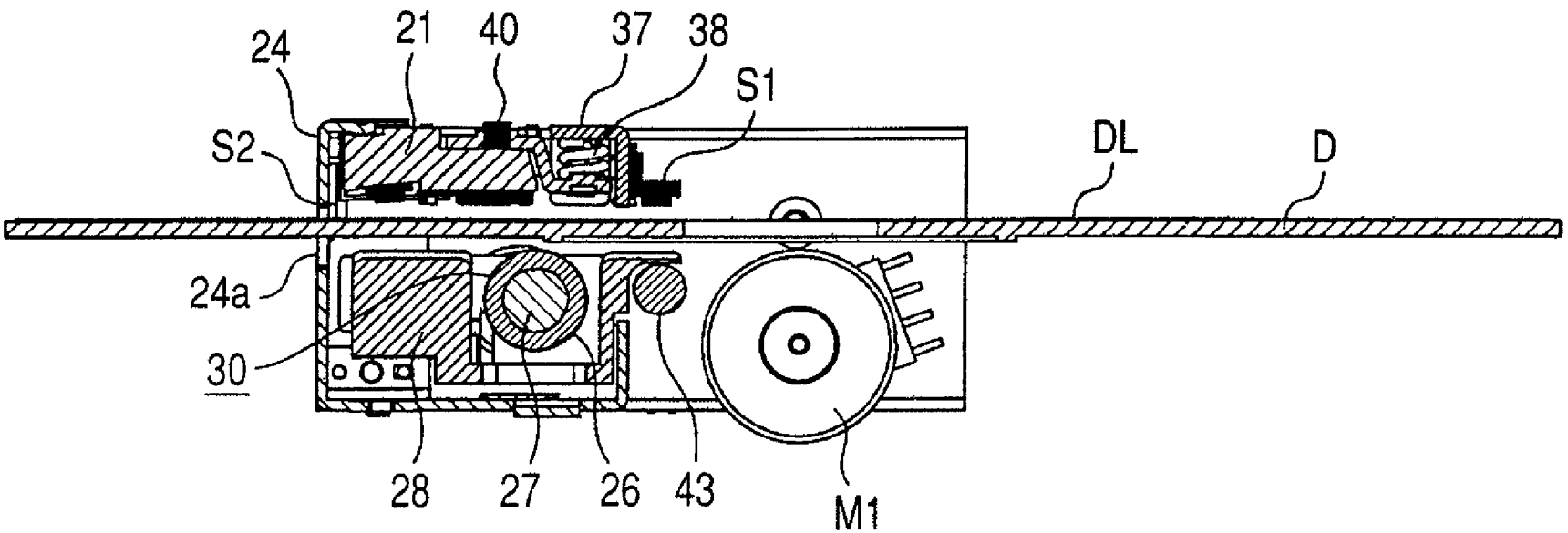
FIG. 4 is a cross-sectional view illustrating the main parts of the printing mechanism shown in FIG. 1.

As shown in FIG. 4, a line thermal head 21 having a plurality of heating elements (not shown) arranged in the longitudinal direction at positions opposite to the platen roller 22 is provided above the platen roller 22. In the thermal head 21, an upper surface of a side portion facing the optical disk driving mechanism 10 and a lower surface of a side portion of an elongated head lever 40 facing the slot 2 are fixed. Both ends of the head lever 40 in the longitudinal direction extend from both ends of the thermal head 21 in the longitudinal direction thereof. In addition, both ends of the head lever 40 in the longitudinal direction thereof are locked to locking grooves 41 formed in the side plates 23 of the frame 25, which face each other. A portion of the connecting plate 24 of the frame 25 extends toward the upper surface and is bent so as to come into contact with an upper surface of a side portion of the thermal head 21 facing the slot 2. In this way, the thermal head 21 having the heating elements fixed thereto is supported such that a portion thereof facing the optical disk driving mechanism 10, that is, an upstream side thereof in the direction in which the optical disk D is transferred during printing is pivoted about the contact portion.

The lower surfaces of both ends of the head lever 40 in the longitudinal direction thereof, which are locked to the locking grooves 41, serve as cam contact portions 42 with which convex cam surfaces 50*b* formed in the cam members 50, which are rotatably provided on the side plates 23 of the frame 25, come into contact.

As shown in FIG. 4, a flat spring plate 37 is provided above the platen roller 22 at a position that is closer to the optical disk driving mechanism 10 than to the thermal head 21. The spring plate 37 is suspended and fixed to the two side plates 23 of the frame 25. A coil spring 38 that applies an elastic urging force in the vertical direction is fixed to the lower surface of the spring plate 37, and a lower end of the coil spring 38 comes into contact with the upper surface of a portion of the head lever 40 provided above the thermal head 21, which faces the optical disk driving mechanism 10. In this way, the coil spring urges the thermal head 21 to a printing position (initial position).

Next, the rotating mechanism of the thermal head 21 will be described.

As described above, a pair of cam members 50 coming into contact with the cam contact portions 42 are provided in the two side plates 23 by fitting the shaft-shaped protrusions 51 having the bores 50*a*, into which the shaft 27 of the platen roller 22 is fixed, into the bores 23*a* formed in the side plates 23. In this embodiment, a driving motor (UD motor) M1 for rotating one of the cam members 50 is provided on the inner surface of one of the side plates 23, and the cam member 50 is provided on the inner surface of the side plates 23 so as to be rotatably supported. In addition, a driving motor (LF motor) M2 for rotating the platen roller 22 that is rotatably supported by the cam members 50 is provided on the outer surface of the other side plate 23, and the other cam member 50 is provided on the outer surface of the side plate 23 so as to be rotatably supported (see FIGS. 2 and 3).

Figure 5:
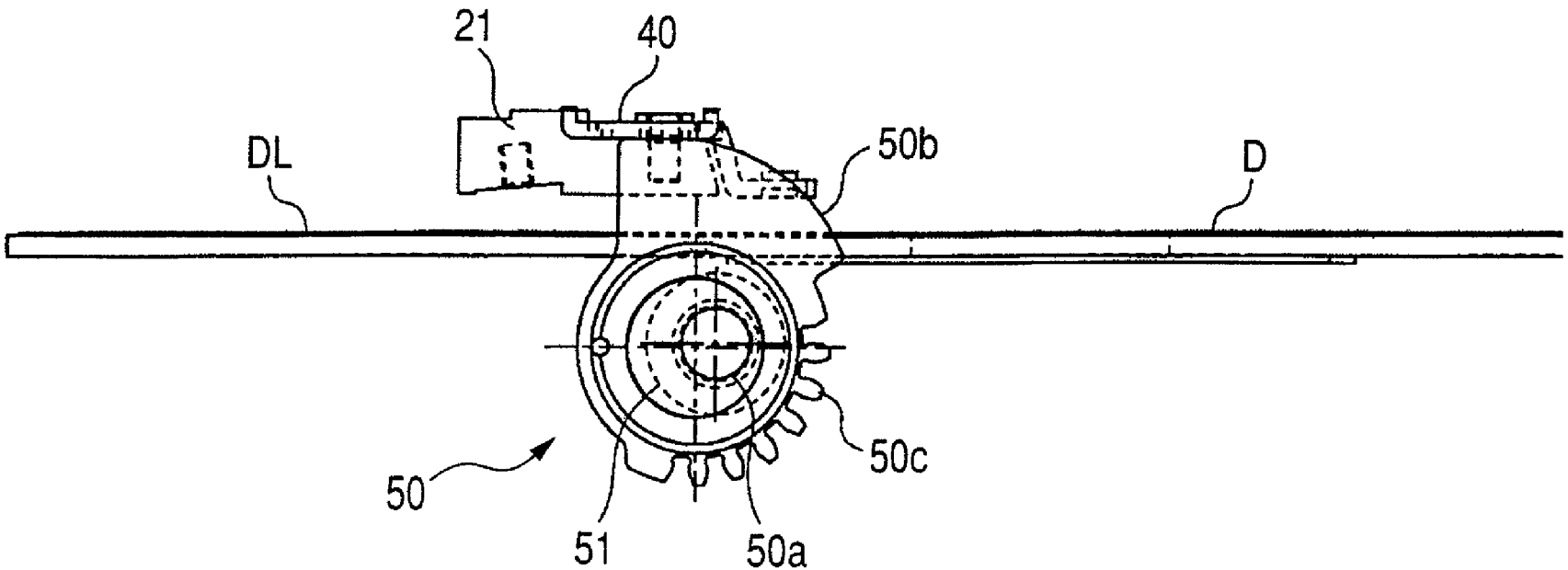
FIG. 5 is a diagram illustrating a rotating mechanism of a thermal head in the printing mechanism shown in FIG. 1 (head-up state)
Figure 6:
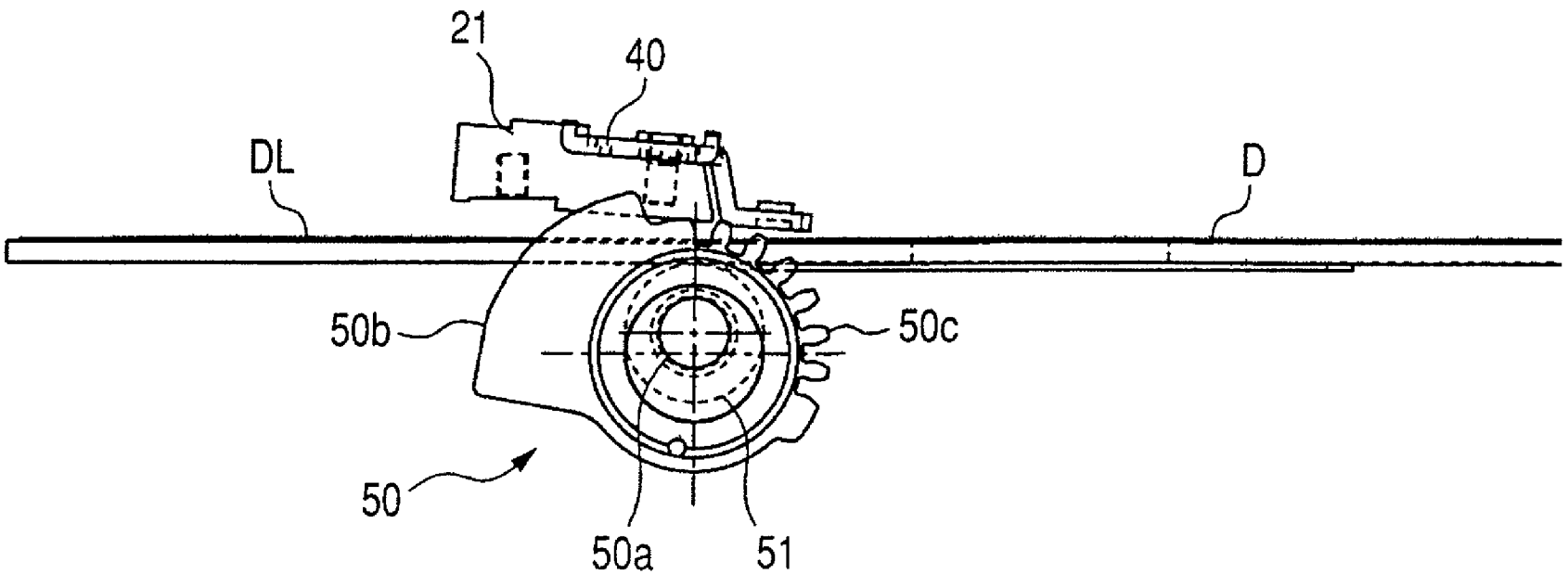
FIG. 6 is a diagram illustrating the rotating mechanism of the thermal head in the printing mechanism shown in FIG. 1 (head-down state)

As show in FIGS. 5 and 6, each of the cam members 50 includes an arc-shaped cam surface 50*b* whose radius from the rotation center gradually varies and a gear portion 50*c* that is engaged with a gear of a transmission system for transmitting the rotating force of the UD motor M1. From the positional relationship between the cam surface 50*b* and the shaft 27 of the platen roller 22 that is eccentrically supported, when the shaft 27 of the platen roller 22 is positioned at the lowest point of a rotation locus (a three o'clock position in FIG. 5) with the rotation of the cam member 50, the cam surface 50*b* is disposed at a position where a large-diameter portion thereof can come into contact with the cam contact portion 42. Similarly, when the shaft 27 of the platen roller 22 is disposed at the uppermost point of the rotation locus (a twelve o'clock position in FIG. 6) with the rotation of the cam member 50, the cam surface 50*b* is disposed at a position where it is separated from the cam contact portion 42.

Furthermore, the pair of cam members 50 can be rotated in synchronization with each other by transmitting the rotating force of the UD motor M1, serving as a driving unit, which is accommodated in a space formed below the disk transfer path in the case 3, using a transmission system including a plurality of cams (not shown) and a rotation connecting shaft 43, and the gear portions 50*c* formed in the cam members 50. When the pair of cam members 50 are rotated such that the shaft 27 of the platen roller 22 is disposed at the uppermost point of the rotation locus, the cam surfaces 50*b* come into contact with the cam contact portions 42 of the head lever 40, and the head lever 40 urged downward by the coil spring 38 can be pushed upward. In this way, the thermal head 21 is in a head-up state in which it is moved so as to be separated from the platen roller 22. In addition, when the pair of cam members 50 are rotated such that the shaft 27 of the platen roller 22 is disposed at the lowest point of the rotation locus, which is the direction in which the optical disk driving mechanism 10 is arranged, the cam surfaces 50*b* of the cam members 50 are separated from the cam contact portions 42 of the head lever 40, and the head lever 40 can return to the printing position by the urging force of the coil spring 38. In this way, the thermal head 21 is in a head-down state in which it comes into pressure contact with the platen roller 22.

In addition, the positions of the bores 29*a* of the box-shaped body 29 are adjusted such that the bores 29*a* form the transfer path of the optical disk D when the top of the platen roller 22 accommodated in the space is substantially flush with the opening of the box-shaped body 29 and the thermal head 21 is in the head-down state.

One leading end of the shafts 27 of the platen roller 22 protrudes toward the outside of the other cam member 50 and is rotatably supported, and a gear (not shown) is provided at the leading end. The gear is engaged with the gear of the transmission system for transmitting the rotating force of the LF motor M2, serving as a driving unit for rotating the platen roller 22. The transmission system includes a plurality of gears and a connecting plate, and is configured so as to be driven with the rotation of the platen roller 22. In the head-down state in which the thermal head 21 is positioned close to the platen roller 22, the transmission system transmits the rotating force of the LF motor M2 as the rotating force of the platen roller 22.

When performing a printing process in response to print signals, which will be described below, the rotating mechanism of the thermal head 21 causes the thermal head 21 to approach the platen roller 22 with the optical disk D interposed therebetween, and rotates the platen roller 22 to transfer and eject the optical disk D after recording. However, during processes other than the printing process, the rotating mechanism causes the thermal head to be separated from the platen roller.

The LF motor M2 is a step motor that is accommodated in a space below the transfer path of the disk so as to be opposite to the UD motor M1 in the case 3. Since the motors M1 and M2 are accommodated in the space in the case 3, it is possible to reduce the size of the disk label printer.

Further, in the disk label printer 1 according to this embodiment, a first sensor S1 and a second sensor S2 are provided to detect the transfer of the optical disk D. The first sensor S1 is provided at the center of the transfer path in the width direction at a position immediately before the thermal head 21 of the printing mechanism 20, which is an upstream side (optical disk driving mechanism side) in the transfer direction of the optical disk D during an eject operation of ejecting the optical disk D from the case 3 to the outside through the slot 2. In addition, the second sensor S2 is provided at the center of the transfer path in the width direction at a position immediately after the thermal head 21. The arrangement of the first and second sensors provided at the center of the transfer path in the width direction makes it possible to reliably detect the leading end or the rear end of an optical disk passing through the center of the transfer path. Further, in this embodiment, the first sensor S1 and the second sensor S2 are composed of reflective sensors having a known structure in which a light emitting unit and a light receiving unit are integrated with each other. The first sensor S1 is fixed to the spring plate 37 and the second sensor S2 is fixed to the thermal head 21 with a sensor board 45 interposed therebetween, such that the first and second sensors face the label surface LD of the optical disk D. In this way, it is possible to appropriately maintain the distance between the first and second sensors S1 and S2 and the surface of the optical disk D, and thus perform a stable sensing operation.

The disk label printer 1 according to this embodiment includes a control unit that controls the driving of the optical disk driving mechanism 10 and the driving of the printing mechanism 20. The control unit is, for example, a CPU that generates and transmits control signals to at least the optical disk driving mechanism 10 and the printing mechanism 20 in response to information input by a user.

Figure 7:
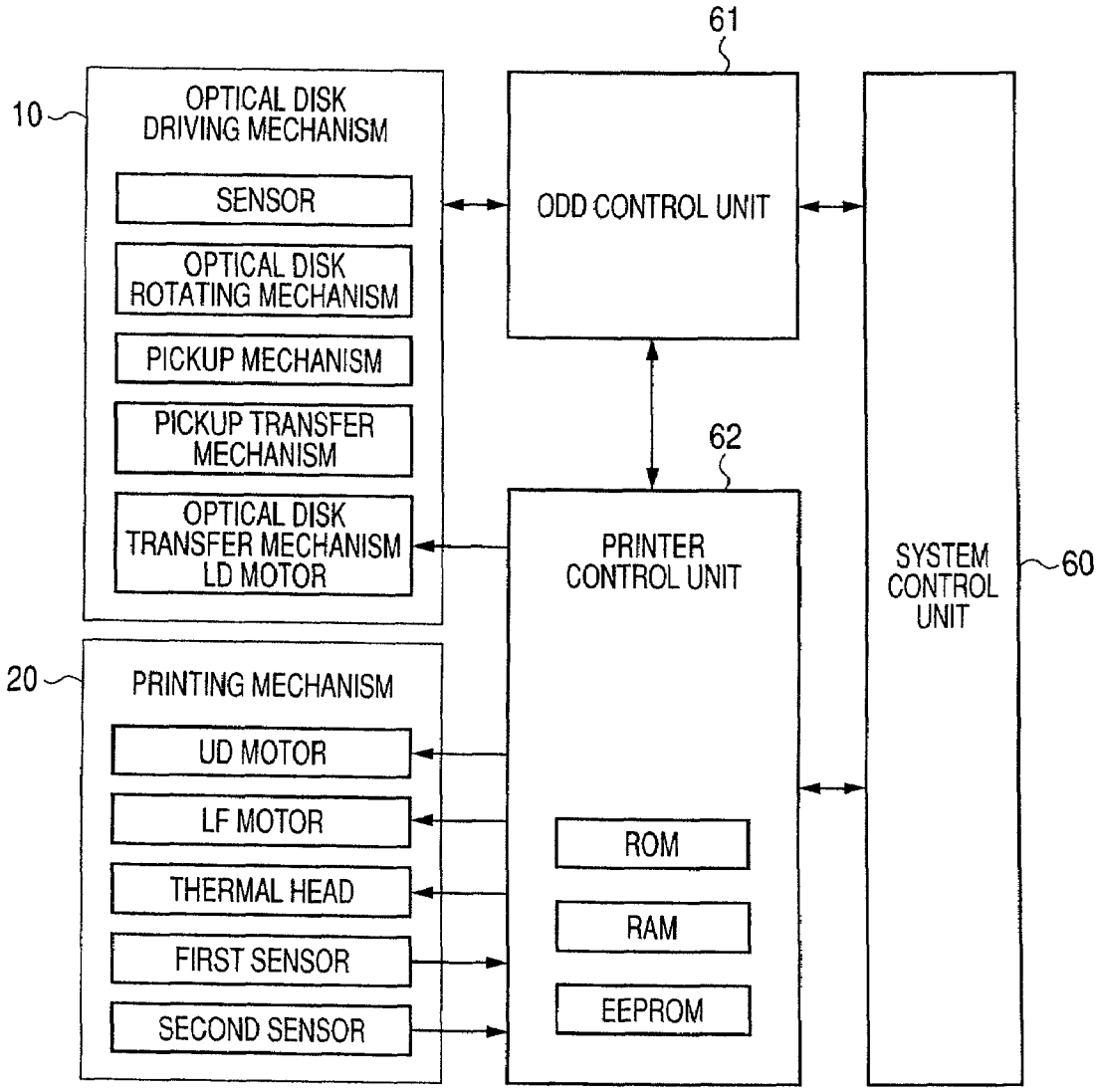
FIG. 7 is a block diagram illustrating a control system of the disk label printer according to the embodiment of the disclosure.

FIG. 7 is a block diagram illustrating the structure of a control system of the disk label printer 1 according to this embodiment. The control unit of the disk label printer 1 according to this embodiment uses a CPU of an electronic apparatus having the disk label printer 1 provided therein as a system control unit 60. The system control unit 60 is connected an ODD control unit 61 that controls the driving of the optical disk driving mechanism 10 and a printer control unit 62 that controls the driving of the printing mechanism 20 by the control board 6. The system control unit 60 and the printer control unit 62 are connected to each other such that they can exchange data therebetween.

The ODD control unit 61 controls the driving of the optical disk rotating mechanism, the pickup mechanism, the pickup transfer mechanism, and the optical disk transfer mechanism. Specifically, the printer control unit 62 controls the operation of the first and second sensors S1 and S2 detecting the optical disk D, the turning-on/off of the heating elements of the thermal head 21, the rotations of the cam members 50 that are operatively associated with the up/down operations of the thermal head 21, and the rotation of the platen roller 22. In addition, the printer control unit 62 controls the driving of the optical disk transfer mechanism of the optical disk driving mechanism 10 through the ODD control unit 61.

The printer control unit 62 stores correction values (offset values) in a storage unit, such as EEPROM, on the basis of a difference in integration accuracy when the printing mechanism 20 is integrated into the case 3, and manages the stored correction values. Then, the printer control unit 62 corrects image data on the basis of the correction values. The correction control will be described below.

In the optical disk D used in this embodiment, a thermal recording medium for color recording having a known structure in which a plurality of coloring layers, which form colors when they are heated in different temperature ranges, are provided on a base composed of a transparent sheet is adhered to the label surface DL. As the thermal recording medium, a thermal recording medium sheet disclosed in, for example, JP-T-2004-530576 or JP-A-2002-370455 can be used.

Next, the driving and control of the disk label printer 1 according to this embodiment will be described.

The disk label printer 1 according to this embodiment performs printing on the label surface DL of the optical disk D during an ejecting operation of ejecting the optical disk D from the inside of the case 3 to the outside of the case 3. Therefore, the disk label printer 1 according to this embodiment prints a desired image on the label surface DL of the optical disk D after the optical disk D having a thermal recording medium sheet for color recording adhered to the label surface DL is mounted to the disk mounting portion in the case 3.

When a desired image print instruction is issued, first, it is detected whether the optical disk D is loaded and the size of the optical disk D. In this case, the ODD control unit 61 controls a sensor (not shown) provided in the optical disk driving mechanism 10 to perform the detection process.

That is, when a desired image is printed on the optical disk D after the pickup mechanism of the disk label printer 1 writes and/or reads signals to and/or from the optical disk D, it is determined that the optical disk D has already been mounted to the disk mounting portion. Therefore, the printer control unit 62 receives from the ODD control unit 61*a* signal indicating that the optical disk D has already been mounted and a signal indicating the size of the optical disk D, and performs a control process for printing in this state.

When the disk label printer 1 is used to perform only a printing operation of printing a desired image, various control operations are performed starting from an operation of mounting the optical disk D to the disk mounting portion. That is, the print control unit instructs the ODD control unit 61 to control the optical disk transfer mechanism to perform a loading operation of loading the optical disk D into the case 3 through the slot 2, thereby mounting the optical disk D to the disk mounting portion. Then, the printer control unit 62 receives from the ODD control unit 61*a* signal indicating that the optical disk D has already been mounted and a signal indicating the size of the optical disk D, and performs a control process for printing in this state.

In this embodiment, the printer control unit 62 corrects image data with reference to the correction values based on a phase difference (difference in integration accuracy) between the optical disk driving mechanism 10 and the printing mechanism 20 when the printing mechanism 20 is integrated into the case 3.

Specifically, in the disk label printer 1 according to this embodiment, the difference in integration accuracy between the disk driving mechanism 10 and the printing mechanism 20 integrated into the case 3 before shipment is measured, and correction values for correcting data related to the print position of an image are determined on the basis of the measured result. The correction values are stored in a storage unit (for example, EEPROM) provided in the printer control unit 62 of the printing mechanism 20. The correction values are classified into correction values for a large-diameter disk and correction values for a small-diameter disk. The correction values are related to a direction orthogonal to the direction in which the optical disk D is transferred during the loading operation and the ejecting operation.

Specifically, large-diameter and small-diameter optical disks, each having a thermal recording sheet graduated in 0.5 mm divisions adhered to its label surface DL, are prepared, and a predetermined image for detecting correction values is printed on each of the large-diameter and small-diameter optical disks. After the printing, the graduations are used to measure the positional deviation of the images for detecting correction values, which are printed on the large-diameter and small-diameter optical disks, in the direction orthogonal to the transfer direction. The positional deviation values are stored in the storage unit as correction values for the print position of image data in the disk label printer 1. In the disk label printer 1 according to this embodiment, the printer control unit 62 performs a control process of correcting the print position of an image with reference to the correction values on the basis of the size of the optical disk D to be printed during a printing operation.

For example, when the printing mechanism 20 is arranged such that its center is shifted about 1 mm from the center of the optical disk driving mechanism 10 to the right side in the transfer direction of the optical disk D, the printer control unit corrects image data received from the system control unit 60 such that the printing mechanism 20 is moved 1 mm, which corresponds to the positional deviation, toward the right side and prints a desired image on the optical disk D that is transferred from the optical disk driving mechanism 10 during the ejecting operation. As described above, since printing control is performed in consideration of the integration accuracy of the disk label printer 1, it is possible to obtain good printing results without a positional deviation. Consequently, this control process is phase change control in the selection of a heating element to be turned on. However, this will be described as a control process of correcting image data for desired printing.

The printer control unit 62 controls the optical disk transfer mechanism of the optical disk driving mechanism 10 to eject the optical disk D to the outside of the case 3 through the slot 2, in order to perform printing on the basis of the corrected image data.

When the second sensor S2 detects the leading end of the optical disk D transferred from the disk mounting portion to the slot 2, the thermal head 21 normally maintained in the head-up state and the platen roller 22 turn to the head-down state in order to print a desired image on the basis of the corrected image data.

That is, in order to separate the cam surfaces 50*b* from the cam contact portions 42 of the head lever, the printer control unit 62 drives the UD motor M1, and the rotating force thereof is transmitted to the pair of cam members 50 through a transmission system, such as a gear, to rotate the cam members in synchronization with each other, thereby returning the head lever 40 to the initial position. When the pair of cam members 50 are rotated, the platen roller 22 rotatably supported by the cam members 50 and the transfer guide member 28 are rotated to the twelve o'clock position, and approach the thermal head 21. In this way, the thermal head 21 approaches the platen roller 22 to turn to the head-down state. Then, the optical disk D that is transferred along the transfer path toward the slot 2 by the ejecting operation is interposed between the thermal head 21 and the platen roller 22, and the transfer operation of the optical disk transfer mechanism transferring the optical disk D ends. Thereafter, the printer control unit controls the driving of the LF motor M2 to rotate the platen roller 22, thereby transferring the optical disk D.

First, when the second sensor S2 detects the leading end of the optical disk D, in order to print a desired image on an appropriate area of the label surface DL of the optical disk D, the printer control unit rotates the platen roller 22 backward to transfer the optical disk D to the optical disk driving mechanism again, thereby executing a so-call printing cue. Then, a printing operation starts to print a desired image. In this case, the system control unit 60 and the printer control unit 62 control the turning-on or turning-off of the corresponding heating elements of the thermal head 21 on the basis of the corrected image data, and selectively supply a necessary amount of heat. The heat causes the thermal recording medium sheet adhered to the label surface DL of the optical disk D with which the thermal head 21 comes into pressure contact to be colored with a desired color, thereby printing a desired image. In addition, the printer control unit drives the LF roller M2 to rotate the platen roller 22 at the time when the heating elements are selectively turned on, thereby transferring the optical disk D toward the slot 2.

In this embodiment, during the transfer of the optical disk D, the guide surfaces 33 of the outward extending portion 34 and the inward extending portion 35 of the transfer guide member 28 that approaches the transfer path in the head-down state come into contact with the rear surface of the optical disk D to guide the transfer of the optical disk D.

In this case, since the length of the heating elements arranged in the thermal head 21 is equal to or larger than the print diameter of the label surface of the optical disk D, it is unnecessary to move the position of the thermal head in the plane direction of the optical disk D, and the number of heating elements turned on may depend on the size of the optical disk D.

After the desired image is completely printed, the printer control unit drives the LF motor M2 again to rotate the platen roller 22 backward, thereby transferring the optical disk D toward the optical disk driving mechanism, such that the optical disk D is accommodated in the transfer path with its leading end protruding from the slot 2.

Then, the printer control unit drives the UD motor M1 to rotate the pair of cam members 50 such that the cam surfaces 50*b* come into contact with the cam contact surfaces of the head lever 40 again, thereby pushing up the thermal head 21 together with the head lever 40. In this case, the thermal head 21 is separated from the platen roller 22 and is displaced to the head-up state by the rotation of the cam members 50. In addition, the platen roller 22 and the transfer guide member 28 are also separated from the thermal head 21 again.

In this case, since the optical disk D having a desired image printed thereon is loaded on the transfer path with its leading end protruding from the slot 2, the user holds the leading end of the optical disk D with fingers and takes out the optical disk from the slot 2, thereby obtaining the optical disk D having a desired image printed thereon.

When signals are written and/or read to and/or from another optical disk D or when a desired image is printed thereon, the optical disk D may be loaded through the slot 2 to the transfer path between the thermal head 21 and the platen roller 22 that are separated from each other in the head-up state. When the leading end of the optical disk D comes into contact with the disk mounting portion of the optical disk driving mechanism 10, the sensor provided in the optical disk driving mechanism 10 detects the contact and transmits a detection signal. Then, the ODD control unit 61 receives the detection signal, and drives the disk transfer mechanism to appropriately mount the optical disk to the disk mounting portion.

Further, the printer control unit 62 determines the backward transfer of the optical disk D during cuing, the forward transfer of the optical disk D during printing, and the backward transfer of the optical disk D for holding after printing, on the basis of the signal indicating the size of the optical disk D that is transmitted from the ODD control unit 61 and the number of steps managed.

In the disk label printer 1 according to this embodiment, the first sensor S1 and the second sensor S2 are used to detect erroneous operations.

That is, (1) when the second sensor S2 detects the leading end of the optical disk D, (2) when the optical disk D is transferred backward to start a cue, (3) when a desired image is completely printed, and (4) when the printed optical disk D is held, the first sensor S1 and the second sensor S2 are turned on (detection)/off (non-detection) as shown in the following Table.

TABLE 1

| | First sensor | Second sensor |
|---|---|---|
| (1) | ON | ON |
| (2) | ON | OFF |
| (3) | OFF | ON |
| (4) | ON | ON |

The printer control unit 62 stores in the storage unit the number of steps of the LF motor M2 for the size of each optical disk D, which is required to change the state of each sensor. The printer control unit compares the number of steps of the LF motor M2 corresponding to the size of the optical disk D provided for printing, which is stored in the storage unit, with the number of steps of the LF motor that is actually required for printing, and determines the transfer error of the optical disk D on the basis of the comparison result.

For example, the printer control unit starts to count the number of steps of the LF motor at the time when the state of the second sensor S2 is changed from the ON state of (1) in which the second sensor S2 detects the leading end of the optical disk D to the OFF state of (2) in which the optical disk D is transferred backward to start a cue.

Then, the printer control unit measures the timing when the state of the first sensor S1 is changed from the ON state of (2) to the OFF state of (3) in which a desired image is completely printed. When the number of steps required is considerably larger than a predetermined number of steps stored in the printer control unit 62, the printer control unit can determine that the optical disk D is slip-transferred. Therefore, in this case, the printer control unit may stop the driving of the printing mechanism 20.

Further, the printer control unit measures the timing when the state of the first sensor S1 is changed from the OFF state of (3) in which a desired image is completely printed to the ON state of (4) in which the printed optical disk D is held. When the number of steps required is considerably larger than a predetermined number of steps stored in the printer control unit 62, the printer control unit can determine that the optical disk D is ejected or taken out from the slot 2 without being transferred backward. Therefore, the printer control unit may finish the driving of the printing mechanism 20.

As described above, the disk label printer 1 according to this embodiment monitors the transfer state of the optical disk D using the first sensor S1 and the second sensor S2, thereby detecting erroneous operations. Therefore, it is possible to prevent serious trouble such as the damage of the printing mechanism 20.

In this way, a high-quality image can be printed on the optical disk D since the positional deviation of the disk label printer due to a difference in integration accuracy is removed by correcting image data.

In the disk label printer according to this embodiment, the slot-in type optical disk driving mechanism and the printing mechanism are integrated with each other, and the printing mechanism does not need to include a mechanism for transferring optical disks, which results in a reduction in the size of the printing mechanism. Therefore, it is possible to reduce the size of the disk label printer and print a high-quality image on the label surface of the optical disk with only one ejecting operation of the optical disk.

Although the exemplary embodiment of the invention has been described above, the invention is not limited thereto. Various modifications and changes of the invention can be made without departing from the scope and spirit of the invention. For example, the correction values stored in the printer control unit may depend on whether the slot is horizontally formed in the disk label printer (horizontal state) or it is vertically formed in the disk label printer (vertical state).

What is claimed is:

1. A disk label printer comprising:

a case that has a slot through which an optical disk is inserted or ejected formed therein;

an optical disk driving mechanism that is provided in the case and writes and/or reads signals to and/or from the optical disk mounted to a disk mounting portion; and a printing mechanism that is provided in the case and includes a thermal head which prints a desired image on a label surface of the optical disk interposed between the thermal head and a platen roller, wherein the printing mechanism is provided on a transfer path of the optical disk toward the optical disk driving mechanism between the slot and the optical disk driving mechanism, the thermal head and the platen roller come into pressure contact with each other with the optical disk interposed therebetween on the transfer path, only when the optical disk is transferred during the driving of the printing mechanism, and the thermal head and the platen roller are withdrawn from the transfer path so as to be separated from each other, when the optical disk is transferred during operations other than the driving of the printing mechanism.

2. The disk label printer according to claim 1, wherein the optical disk is transferred during the driving of the printing mechanism by rotating the platen roller that comes into pressure contact with the thermal head with the optical disk interposed therebetween.

3. The disk label printer according to claim 1, wherein the printing mechanism includes transfer guide members that have guide surfaces provided before and after the platen roller on the transfer path when the optical disk is transferred during the driving of the printing mechanism.

* * * * *